US008727116B2

(12) United States Patent
Kim et al.

(10) Patent No.: US 8,727,116 B2
(45) Date of Patent: May 20, 2014

(54) PROTECTION COVER FOR PORTABLE TERMINAL

(75) Inventors: Yoon-Young Kim, Gyeonggi-do (KR); Sang-Geun Kim, Gyeonggi-do (KR); Sang-Yul Kim, Gyeonggi-do (KR); Seog-Guen Kim, Seoul (KR); Jin-Soo Kim, Gyeonggi-do (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 13/240,169

(22) Filed: Sep. 22, 2011

(65) Prior Publication Data

US 2012/0085679 A1 Apr. 12, 2012

(30) Foreign Application Priority Data

Oct. 6, 2010 (KR) ..... 10-2010-0097395

(51) Int. Cl.
*B65D 85/00* (2006.01)

(52) U.S. Cl.
USPC ..... 206/320; 206/45.23; 206/45.2

(58) Field of Classification Search
USPC ..... 206/320, 477, 480, 472, 736, 45.24, 206/751, 762, 45.2, 45.23, 586; 248/460; 361/679.55, 679.56, 679.3
See application file for complete search history.

(56) References Cited

U.S. PATENT DOCUMENTS

| | | | | |
|---|---|---|---|---|
| 5,775,497 | A * | 7/1998 | Krulik | 206/320 |
| 6,437,974 | B1 * | 8/2002 | Liu | 361/679.27 |
| 6,616,111 | B1 * | 9/2003 | White | 248/309.1 |
| 6,667,878 | B2 * | 12/2003 | Ponx | 361/679.04 |
| 6,772,879 | B1 * | 8/2004 | Domotor | 206/45.23 |
| 7,136,282 | B1 * | 11/2006 | Rebeske | 361/679.55 |
| 7,318,521 | B2 * | 1/2008 | Lau | 206/45.24 |
| 7,584,841 | B2 * | 9/2009 | Chan et al. | 206/45.23 |
| 8,107,228 | B2 * | 1/2012 | Sassounian | 361/679.26 |
| 8,151,982 | B2 * | 4/2012 | Still | 206/45.23 |
| 2002/0017545 | A1 | 2/2002 | Badillo et al. | |
| 2006/0226040 | A1 * | 10/2006 | Medina | 206/320 |
| 2008/0053851 | A1 * | 3/2008 | Ko et al. | 206/320 |
| 2009/0230161 | A1 * | 9/2009 | Emsky | 224/257 |
| 2009/0244832 | A1 * | 10/2009 | Behar et al. | 361/679.55 |
| 2009/0314400 | A1 * | 12/2009 | Liu | 150/165 |
| 2010/0110629 | A1 * | 5/2010 | Dietz et al. | 361/679.55 |
| 2010/0149739 | A1 * | 6/2010 | Mish et al. | 361/679.02 |
| 2010/0294683 | A1 * | 11/2010 | Mish et al. | 206/320 |
| 2011/0240448 | A1 * | 10/2011 | Springer et al. | 200/331 |

(Continued)

FOREIGN PATENT DOCUMENTS

| | | | |
|---|---|---|---|
| DE | 20-2010-006517 | U1 | 9/2010 |
| EP | 1841082 | A1 | 10/2007 |

*Primary Examiner* — Steven A. Reynolds
(74) *Attorney, Agent, or Firm* — Cha & Reiter, LLC

(57) ABSTRACT

A protection cover for a portable terminal preferably includes a rear cover, on and from a surface of which the portable terminal is mountable and removable, and a front cover pivotally coupled to the rear cover to open or close access to the portable terminal mounted on the rear cover. Friction members may be provided on at least one of the rear cover and the front cover, respectively, in which the front cover is disposed at a predetermined angle with respect to the rear cover while facing another surface of the rear cover to support the friction members on a planar surface, thereby opening the portable terminal and cradling the portable terminal inclinedly with respect to the planar surface. The protection cover provides both a cradle and a cover in one device.

18 Claims, 9 Drawing Sheets

(56) References Cited

U.S. PATENT DOCUMENTS

2011/0290687 A1* 12/2011 Han ..... 206/320
2011/0297564 A1* 12/2011 Kim et al. ..... 206/320
2011/0297581 A1* 12/2011 Angel ..... 206/736
2012/0043234 A1* 2/2012 Westrup ..... 206/320
2012/0043247 A1* 2/2012 Westrup ..... 206/472
2012/0118770 A1* 5/2012 Valls et al. ..... 206/320
2012/0125809 A1* 5/2012 Leung ..... 206/736
2012/0153116 A1* 6/2012 Harrison ..... 248/460

* cited by examiner

PROTECTION COVER FOR PORTABLE TERMINAL

CLAIM OF PRIORITY

This application claims the benefit of priority under 35 U.S.C. §119(a) of a Korean Patent Application filed in the Korean Intellectual Property Office on Oct. 6, 2010 and assigned Serial No. 10-2010-0097395, the entire disclosure of which is hereby incorporated by reference.

BACKGROUND OF THE INVENTION

1. Field of the Invention

The present invention relates to a protection cover for various portable products. More particularly, the present invention relates to a protection (i.e. protective) cover for a portable terminal such as a portable phone, a portable game player, a portable multimedia device, a table Personal Computer (PC), or the like.

2. Description of the Related Art

Generally, a portable product literally describes a product which a user operates when necessary while carrying it or at different locations. Such portability increases the risk of damage to the product, and a carrying case commensurate with the type of product being protected is fairly common, particularly for more fragile products. For example, a case for carrying cosmetic products has already come into wide use for many, many years, and recently, men and women of all ages carry portable terminals, such as portable phones, portable game players, portable multimedia devices, table Personal Computers (PCs), or the like. The market for cases that protect portable terminals from shocks or scratches is expanding constantly.

To prevent the exterior of a portable product from being damaged, users often use protective covers. Herein, such protection covers include a pouch that contains the portable product therein and an external case is directly mounted on the exterior of the portable terminal. The protection cover, in an early stage thereof, has been used merely to keep or protect a portable product, but with the popularity and widespread use of portable phones, the protection cover is also used for decorative purposes. In other words, a portable terminal such as a portable phone is used not only for a communication function, but also as fashion accessory for expressing a user's individuality.

Meanwhile, users of portable terminals having reinforced multimedia functions, such as smart phones or table PCs, as well as portable multimedia devices. Such users often purchase separate cradles such as docking stations. The cradles enable the terminals to be inclinedly cradled on the plane such as the desk or the ground, allowing users to conveniently view moving pictures or the like through the portable terminal.

Users utilizing a protection cover and a separate cradle often separate a portable terminal from the protection cover to cradle the portable terminal on the cradle or remove the portable terminal from the cradle to couple the portable terminal to the protection cover. However, in practice, it is inconvenient for the user to carry the cradle at all times. Moreover, since the user environment of such portable terminal is subject to many changes at any time because of the portability, it is very cumbersome for the mobile user to switch position of the portable terminal from the protection cover to the cradle or from the cradle to the protection cover.

SUMMARY OF THE INVENTION

Accordingly, an exemplary aspect of the present invention is to provide a protection cover which can be conveniently used both to protect and cradle a portable terminal.

Another exemplary aspect of the present invention is to provide a protection cover for a portable terminal, which can easily adjust an inclination of the portable terminal with respect to a plane to provide a cradle the portable terminal.

According to an exemplary aspect of the present invention, there is provided a protection cover for a portable terminal. The protection cover includes a rear cover having a surface of which the portable terminal can be removably mounted on and removed therefrom, a front cover pivotally coupled to the rear cover for opening or closing the portable terminal removably mounted on the rear cover, and friction members provided on at least one of the rear cover and the front cover, respectively, in which the front cover is disposed at a predetermined angle with respect to the rear cover while facing another surface of the rear cover to support the friction members on a planar surface, thereby opening the portable terminal and cradling the portable terminal inclinedly with respect to the planar surface.

The protection cover may further include at least one or more hooks provided on a surface of the rear cover to bind the portable terminal to the rear cover.

The protection cover may further include a connection member preferably made of a flexible material, a side end portion of which is connected to a side edge portion of the rear cover and another-side end portion of which is connected to a side edge portion of the front cover, in which the front cover is coupled to the rear cover to pivot through the connection member.

The fiction members may be provided on edge portions of the rear cover and the front cover, respectively.

The protection cover may further include a connection member preferably made of a flexible material, a side end portion of which is connected to a side edge portion of the rear cover and another-side end portion of which is connected to a side edge portion of the front cover, in which the front cover is coupled to the rear cover to pivot through the connection member, and the friction members are provided on another-side edge portions of the rear cover and the front cover, respectively.

The protection cover may further include at least one hook provided on a surface of the rear cover to bind the portable terminal to the rear cover and a binding member for binding the front cover to the rear cover when the front cover is positioned to close the portable terminal, in which the friction members are provided on outer surfaces of the at least one hook and the binding member.

The protection cover may further include. for example, an inner skin portion and an outer skin portion made of leather or leather-like material, in which the inner skin portion and the outer skin portion comprise portions for forming the rear cover, portions for forming the front cover, and a portion for forming the connection member, and the inner skin portion and the outer skin portion are coupled to each other while facing each other.

The inner skin portion and the outer skin portion may be coupled to each other by being adhered or sewn to each other while facing each other.

The protection cover may further include frames or boards interposed between the inner skin portion and the outer skin portion in the portions for forming the rear cover and the front cover. In this particular case, the protection cover may further include at least one hooks provided on a surface of the rear cover to bind the portable terminal to the rear cover, in which the hooks are formed integrally with the frames or boards.

The rear cover and the front cover may further include frames or boards interposed therebetween and the connection member may comprise a silicon member connecting the frames or boards to each other.

The protection cover may further include an inner skin portion and an outer skin portion made of leather, which cover the frames or boards.

The silicon member may be disposed such that both end portions of the silicon member partially cover both surfaces of the frames or boards. In this case, the silicon member may be fixed to the frames or boards by double injection or adhesion processing.

In another exemplary aspect of the invention, a protection cover for a portable terminal preferably includes a rear cover having an inner surface adapted for the portable terminal being mounted thereon and removed therefrom; a front cover pivotally coupled to the rear cover to open or close access to the portable terminal when the portable terminal is mounted on the rear cover; and friction members provided on the rear cover and the front cover, respectively, wherein the front cover and rear cover form a cradle when the front cover is disposed at a predetermined angle with respect to the rear cover while facing an outer surface of the rear cover to support placement of the friction members of both the front cover and the rear cover on a planar surface, said predetermined angle thereby opening access to the portable terminal and cradling the portable terminal inclinedly with respect to the planar surface.

The protection cover may include one or more retainers provided on a surface of the rear cover to bind the portable terminal to the rear cover. The one or more retainers may comprise one or more hooks.

BRIEF DESCRIPTION OF THE DRAWINGS

The above and other exemplary features and advantages of exemplary embodiments of the present invention will become more apparent to a person of ordinary skill in the art from the following detailed description taken in conjunction with the accompanying drawings, in which.

DETAILED DESCRIPTION

Hereinafter, exemplary embodiments of the present invention will be described in detail with reference to the accompanying drawings. A detailed description of known functions and configurations will be omitted when it may unnecessarily obscure appreciation of the subject matter of the present invention by a person of ordinary skill in the art. A person of ordinary skill in the art should understand and appreciate that the examples provided herein are for illustrative purposes and that the protection cover according to the presently claimed invention is not limited to the examples shown and described herein.

Figure 1:
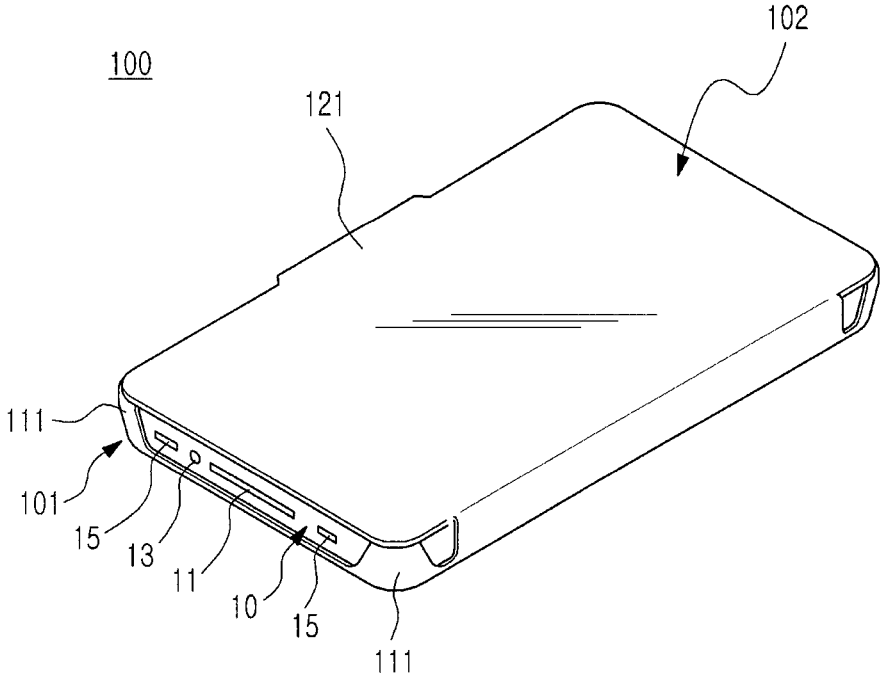
FIG. 1 is a perspective view of a protection cover for a portable terminal according to an exemplary embodiment of the present invention.
Figure 2:
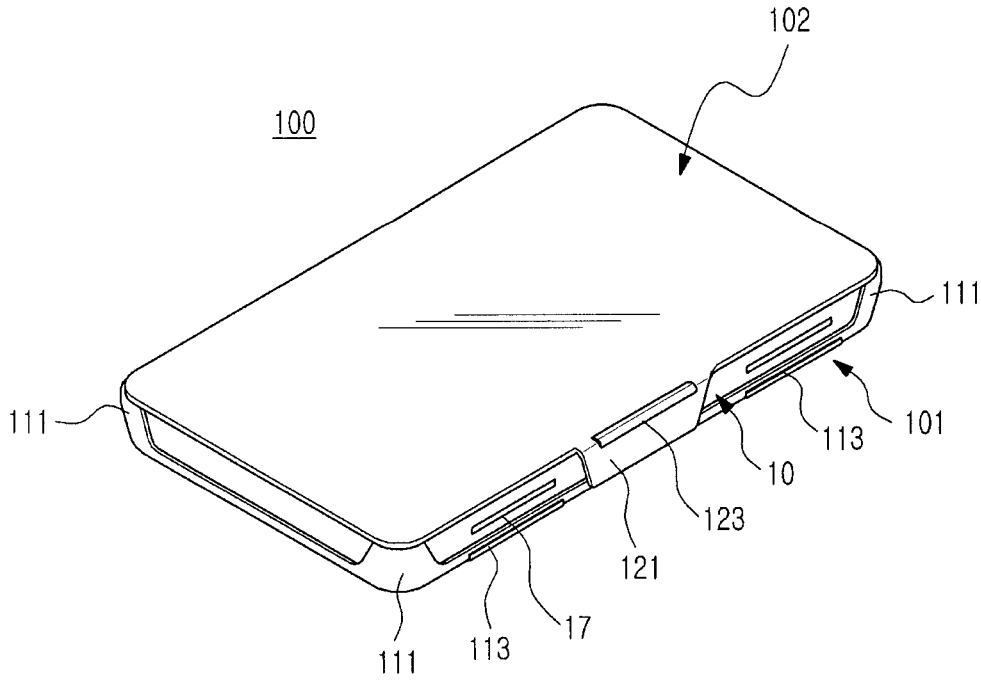
FIG. 2 is a perspective view of the protection cover shown in FIG. 1, when viewed from another direction.
Figure 3:
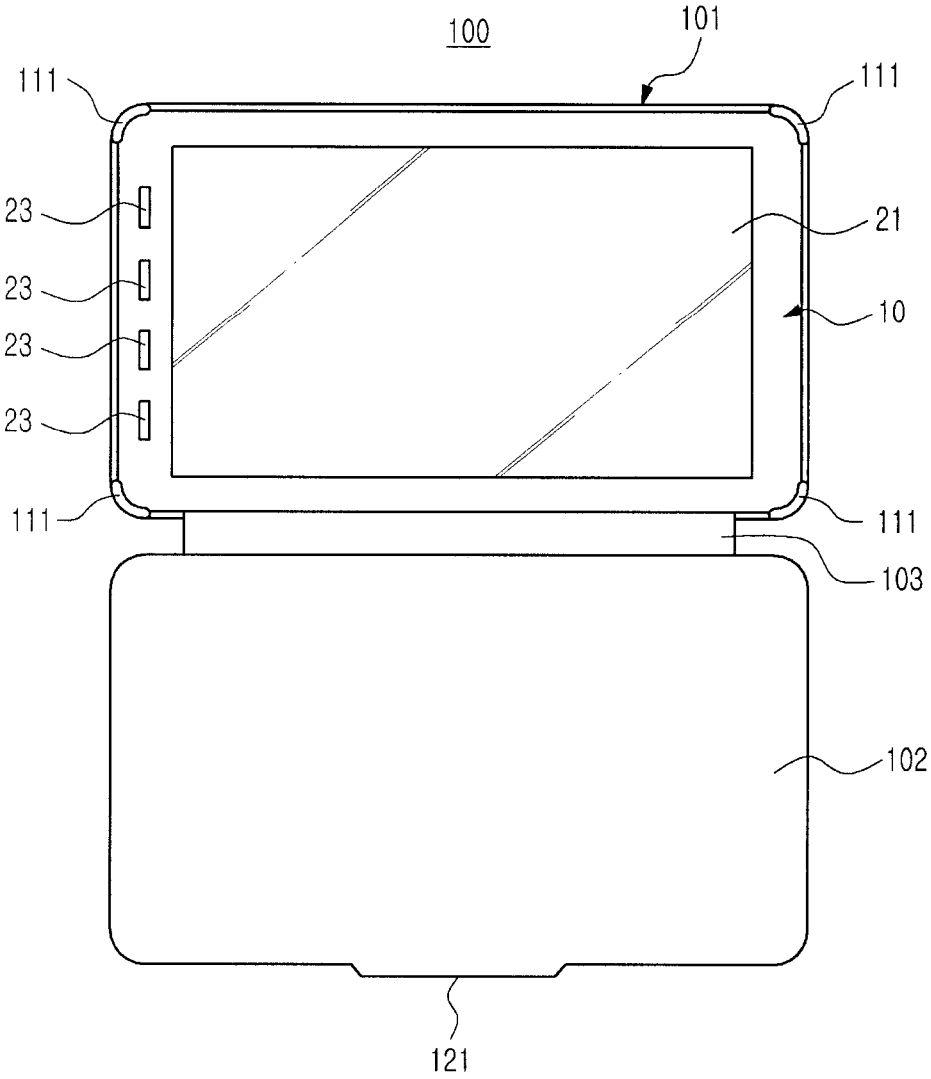
FIG. 3 is a plan view of the portable terminal mounted on the protection cover shown in FIG. 1 in an open position.
Figure 4:
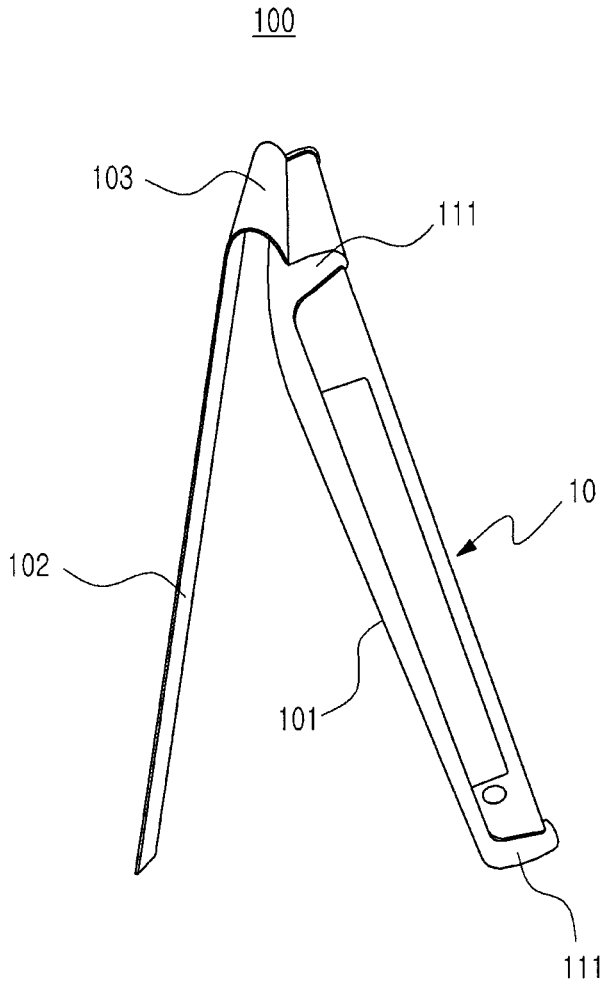
FIG. 4 is a view showing a state in which the portable terminal mounted on the protection cover shown in FIG. 1 is positioned inclinedly on a planar surface.

As shown in FIGS. 1 through 5, a protection cover 100 for a portable terminal 10 according to an exemplary embodiment of the present invention is structured such that a front cover 102 is pivotally coupled to a rear cover 101 (FIG. 4). The portable terminal 10 is mountable on and removable from the rear cover. The front cover 102 pivots a predetermined angle with respect to the rear cover 101 to support the front cover 102 on the plane.

As shown in FIG. 2, on the rear cover 101 and the front cover 102 are optionally installed friction members 113 and 123, respectively, to prevent the rear cover 101 and the front cover 102 from sliding when they are supported on the plane. A person of ordinary skill in the art understands and appreciates that a roughened surface at the area identified at 113 and 123 could also constitute friction members. Therefore, without using a separate cradle, the portable terminal 100 can be cradled inclinedly on a planar surface using the protection cover 100. Thus, the protection cover is both a protection cover and cradle in one.

The front cover 102 and the rear cover 101 are made preferably of a flexible material, such as natural leather, artificial leather, silicon, or the like, just to name a few possibilities in order to protect the portable terminal 10 mounted on the protection cover 100, and may be used as an article for exterior decoration. Silicon, by its nature, may maintain a constant shape, but a material such as natural leather cannot maintain a constant shape. Therefore, it is desirable to maintain the shape of the front cover 102 and the rear cover 101 constant, preferably in the form of a flat board, by using a frame or a board corresponding to the shape of the portable terminal 10.

Referring now to FIG. 3, on a surface of the portable terminal 10 is installed a display device 21, and on a side of which may be disposed keys 23 for doing a search or calling a menu. On sides of the portable terminal 10 may also be disposed items such as a key 17 for volume adjustment or menu movement, an interface terminal 11 for connection with an external device, a jack connector 13 for connection with an earphone, and memory slots 15 and 19. These items could be in different locations other than sides of the portable terminal, and a person of ordinary skill in the art appreciates that such variations are possible and the protection cover is designed with such items in mind. The portable terminal 10 may comprise, for example, a smart phone, a tablet PC, a full touch phone, a portable game player, or a multimedia player, just to name of few of the many devices that can benefit from the presently claimed invention.

Referring now to FIGS. 3 and 4, on a surface of the rear cover 101 are provided at least one hooks 111 which are preferably provided at four corner portions of the rear cover 101 to bind the portable terminal 10 to the rear cover 101. In other words, the hooks 111 in this example are provided on the rear cover 101 at the four corner portions of the portable terminal 10, such that the portable terminal 10 can be fixed to the rear cover 101. Although the hooks 111 are provided at the four corner portions of the rear cover 101 in the current embodiment of the present invention, a pocket may be formed on a surface of the rear cover 101 to push the portable terminal 10 into the pocket in a longitudinal direction or a widthwise direction. In this case, such hooks 111 are not necessary. However, to allow simple manipulation and watching of a moving image through the portable terminal 10 when the portable terminal 10 is coupled with the rear cover 101, the display device 21 and the keys 23 should be exposed to outside as can be easily understood by those of ordinary skill in the art. In other words, when the rear cover 101 is manufactured in the form of a pocket to receive the portable terminal 10 therein, without installing the hooks 111, it is desirable to remove a portion of the pocket to expose the display device 21 through the removed portion.

In addition, while the portable terminal 10 may be coupled to the rear cover 101 in a way to push the portable terminal 10, the portable terminal 10 may also be fixed to the rear cover 101 by using the hooks 111. For example, in the state shown in FIG. 3, ribs in the form of a guide, which extend in the longitudinal direction from both side ends of the rear cover 101 (which extend in the widthwise direction from an upper end portion and a lower end portion of the rear cover 101 in the state shown in FIG. 1), are formed to push against the portable terminal 10 in the longitudinal direction, and hooks are formed on the upper end portion and the lower end portion of the rear cover 101 to fix/secure the portable terminal 10 at a predetermined position.

As such, a structure for coupling and fixing the portable terminal 10 to the rear cover 101 may be provided in a various amount of ways that are within the spirit of the invention and scope of the appended claims. For example, it is possible that an elastic material could be used that is biased to grip the portable terminal.

With continued reference to FIG. 3, the front cover 102 is pivotally coupled to the rear cover 101 to open or close the portable terminal 10 coupled to the rear cover 101. The front cover 102 is preferably provided with a binding member 121 to bind and fix the front cover 102 to the rear cover 101 in a closed state of the portable terminal 10. To pivotally couple the front cover 102 to the rear cover 101, the protection cover 100 includes a connection member 103.The connection member may comprise a hinge. The connection member 103 is preferably made of a flexible material such as natural leather, artificial leather, or silicon, a side end of which is connected to a side edge portion of the rear cover 101 and another side end of which is connected to a side edge portion of the front cover 102. Thus, for example, the front cover 102 is pivotally coupled to the side edge portion of the rear cover 101 through the connection member 103. Meanwhile, the binding member 121 is provided on another-side edge portion of the front cover 102, and is bound to another-side edge portion of the rear cover 101 in a closed state of the portable terminal 10.

Although the rear cover 101, the front cover 102, and the connection member 103 are separately described in the protection cover 100 in the current exemplary embodiment of the present invention, the aforementioned items may be manufactured with a single material in a single body when the material is, for example, leather or silicon, thereby reducing a cost or simplifying a manufacturing process.

Figure 6:
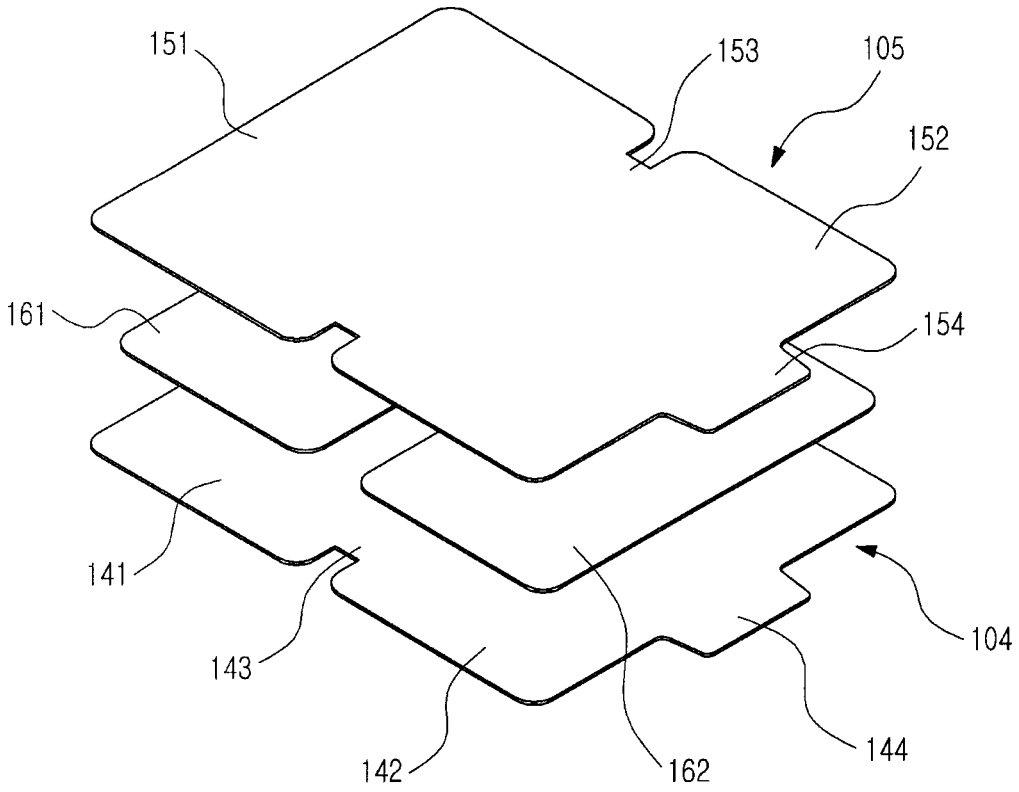
FIG. 6 is an exploded perspective view of the protection cover shown in FIG. 1.

For example, when leather is used, as shown in FIG. 6, inner skin 104 and outer skin 105 are formed in the same manner such that they have portions 141 and 151 in which the rear cover 101 is to be formed, portions 142 and 152 in which the front cover 102 is to be formed, and portions 143 and 153 in which the connection member 103 is to be formed, and they are adhered, coupled or sewn to each other while facing each other. Between the portions 141 and 142 and the portions 151 and 152 in which the rear cover 101 and the front cover 102 are to be formed are interposed frames or boards 161 and 162 in a predetermined shape, so that the inner skin 104 and the outer skin 105 can maintain the flat board form. The hooks 111 may be manufactured integrally with the frame or board 161 interposed between the portions 141 and 151 in which the rear cover 101 is to be formed.

Figure 7:
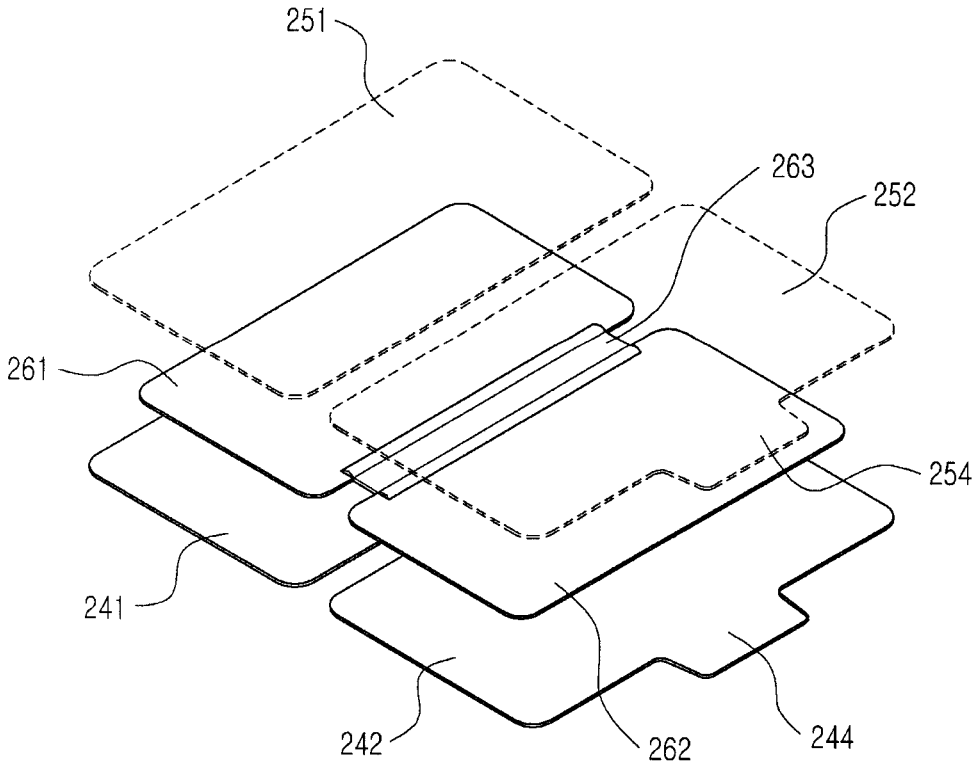
FIG. 7 is an exploded perspective view of a modified form of the protection cover shown in FIG. 1.
Figure 8:
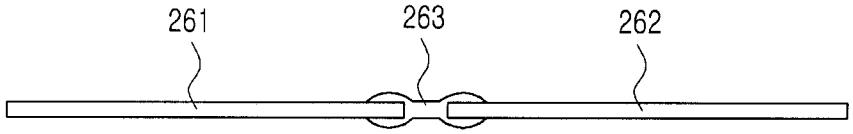
FIG. 8 is a view for describing a connection member of the protection cover shown in FIG. 7.

When the rear cover 101 and the front cover 102 are made of leather and the connection member 103 is made of silicon, as shown in FIG. 7, a member made of silicon 263, may be provided to connect the frames or boards 261 and 262 to be disposed inside the rear cover 101 and the front cover 102. In this case, both end portions of the silicon member 263 are formed to partially cover both surfaces of the frames or boards 261 and 262, and upon molding of the silicon member 263 by double injection, and the frames or boards 261 and 262 to be disposed inside the rear cover 101 and the front cover 102 may be connected to each other. Without using double injection, the silicon member 263 may be separately manufactured and may be adhered and fixed to the frames or boards 261 and 262 such that the both end portions of the silicon member 263 partially cover the both surfaces of the frames or boards 261 and 262. Also in this case, the frames or boards 261 and 262 are preferably covered with inner skin portions 241 and 242 and outer skin portions 251 and 252 made of leather.

In FIGS. 6 and 7, portions 144, 154, 244, and 254 are used to form the binding member 121.

The friction members 113 and 123 are provided on edge portions of the rear cover 101 and the front cover 102, respectively.

Figure 5:
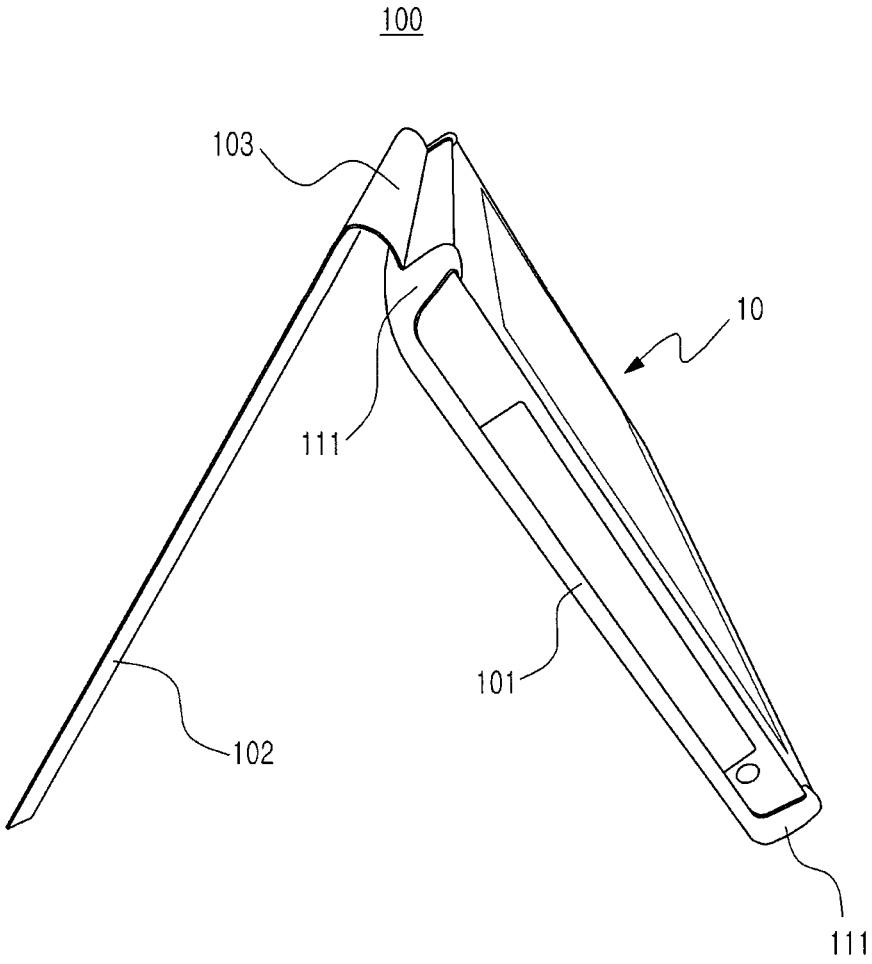
FIG. 5 is a view showing a state in which an inclination angle of the portable terminal shown in FIG. 4 is adjusted.

Referring now to FIGS. 4 and 5, when the protection cover 100 is positioned on a plane, e.g., the desk or the ground in a state where the front cover 102 has a predetermined angle with respect to the rear cover 101 while facing another side of the rear cover 101, the portable terminal 10 may be positioned inclinedly with respect to the plane. In this state, the friction members 113 and 123 are supported on the plane, thereby preventing the protection cover 100, more specifically the front cover 102 and the rear cover 101 from sliding on the plane. Thus, the friction members 113 and 123 are preferably provided at portions opposite to the connection member 103, that is, at other-side edge portions of the front cover 102 and the rear cover 101. In the current exemplary embodiment, the friction members 113 and 123 are provided on an outer circumferential surface of the hooks 111 positioned at another side of the rear cover 101 among the hooks 111 and on an outer circumferential surface of the binding member 121.

The friction members 113 and 123 prevent the front cover 102 and the rear cover 101 from sliding while supporting the weight of the portable terminal 10 when the portable terminal 10 is cradled inclinedly on the plane. Therefore, the friction members 113 and 123 are preferably manufactured of a material having a high friction coefficient. For example, the friction members 113 and 123 are preferably manufactured of silicon or rubber. Meanwhile, in the current embodiment, positions at which the friction members 113 and 123 are attached are shown in FIG. 2, and preferably, the friction members 113 and 123 are attached to edge portions of the rear cover 101 formed by contact between side portions of the portable terminal 10 and a portion covering the rear surface of the portable terminal 10 and to an edge portion which may be a boundary between the front cover 102 and the binding member 121. In production, as shown in FIGS. 4 and 5, proper positions on the front cover 102 and the rear cover 101 may be selected as attaching portions of the friction members 113 and 123, taking account of the portions which are to contact the plane when the portable terminal 10 is cradled inclinedly on the plane.

Since the front cover 102 and the rear cover 101 are connected through the connection member 103 made of a flexible material, an open angle may be variously adjusted when they pivot away from each other. Thus, when the portable terminal 10 is cradled on the plane, the user can adjust a screen display direction of the display device 21 suitably for a use environment or a user's posture by easily controlling an inclination of the portable terminal 10 with respect to the plane.

Figure 9:
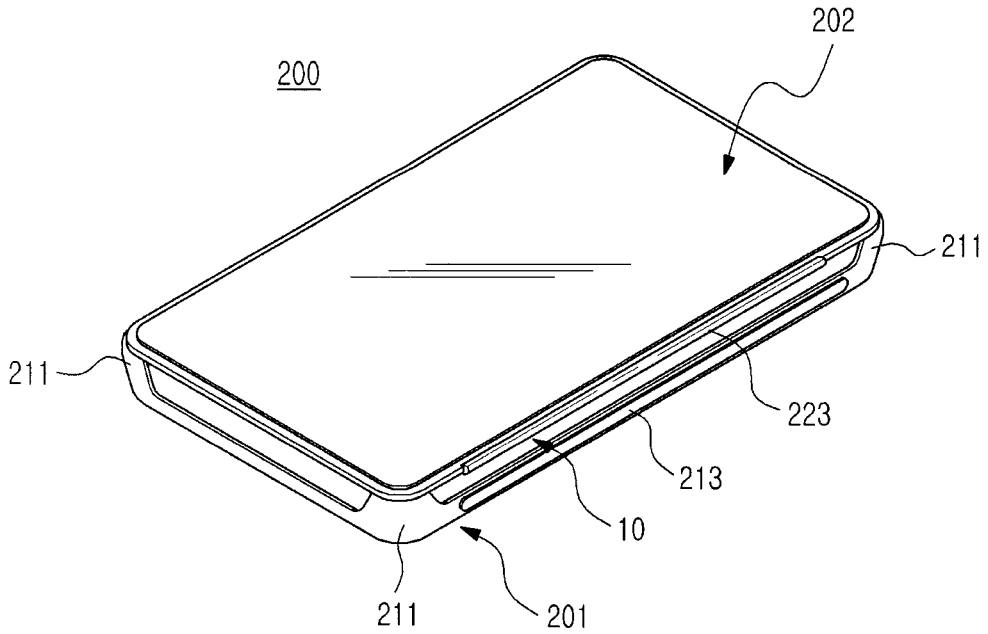
FIG. 9 is a perspective view of a protection cover for a portable terminal according to another exemplary embodiment of the present invention.
Figure 10:
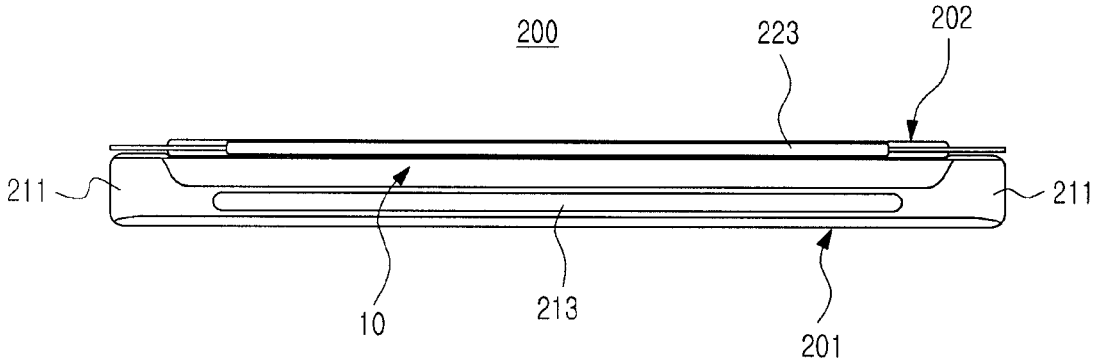
FIG. 10 is a side view of the protection cover shown in FIG. 9.

FIGS. 9 and 10 show a protection cover 200 for the portable terminal 10 according to another exemplary embodiment of the present invention. The protection cover 200 according to the current exemplary embodiment of the present invention is different from the protection cover 100 according to the previous exemplary embodiment in that the protection cover 200 does not use a separate binding member. In this case, a front cover 202 and hooks 211 formed on a rear cover 201 stick to each other by using a magnetic substance, thereby maintaining a closed state of the portable terminal 10 bound to the rear cover 201. In this case, a rubber magnet may be used for the magnetic substance.

The protection cover 200 includes the rear cover 201 and the front cover 202 which are pivotally coupled with each other by a connection member (not shown). The protection cover 200 can be manufactured from a single material in a single body, but for simplification of a description of structure, the protection cover 200 is separated into the rear cover 201, the front cover 202, and the connection member. The connection member is positioned in a side not shown in FIG. 9, on a side opposite to which are disposed friction members 213 and 223.

The friction members 213 and 223 are positioned on edge portions of the rear cover 201 and the front cover 202, preferably on the side opposite to the connection member in a closed state of the portable terminal 10 bound to the rear cover 201. The friction members 213 and 223 preferably protrude more than other portions disposed on the side opposite to the connection member, such that the friction members 213 and 223 are supported directly on the plane when the portable terminal 10 is cradled on the plane by using the protection cover 200 as shown in FIGS. 4 and 5.

As can be appreciated from the foregoing description, according to the present invention the protection cover for the portable terminal is structured such that the friction members are supported on the plane when the front cover is open at a predetermined angle with respect to the rear cover, thereby cradling the portable terminal inclinedly with respect to the plane. Thus, the user can comfortably enjoy a multimedia service such as a moving picture through the portable terminal placed on the plane such as the desk or the ground at home or in the office. Moreover, an open angle of the front cover with respect to the rear cover can be easily adjusted, allowing the user to conveniently adjust the inclination of the portable terminal with respect to the plane.

While detailed exemplary embodiments have been described in the present invention, those of ordinary skill in the art should understand and appreciate that various changes may be made without departing from the scope of the present invention. For example, the terms "front" and "rear" are relative terms and can be interpreted to mean first and second, left and right, etc.

What is claimed is:

1. A protection cover for a portable terminal, comprising:

a rear cover having an outer surface and having an inner surface adapted for the portable terminal being mounted thereon and removed therefrom;

ribs extending from a first and second side edge of the rear cover for orienting the portable terminal on the rear cover;

a front cover pivotally coupled to the rear cover to open or close access to the portable terminal when the portable terminal is mounted on inner surface of the rear cover, the front cover having an outer surface and a binding member, monolithically formed with and extending from an edge of the front cover, to engage the rear cover to bind the rear cover to the front cover when the front cover closes access to the portable terminal; and at least two friction members in an unaligned alternating arrangement on the front cover and on the rear cover, respectively of which at least a first friction member is provided on a portion of the rear cover and a second friction member provided on a portion of the front cover in which the first friction member and the second friction member are facing the same direction when the protection cover is closed, and wherein the at least two friction members are selected from the group consisting of silicon and rubber, and with a set spacing apart of the at least two friction members and a substantial frictional engagement of the set spaced apart at least two friction members with a planar surface sets and fixes an angle between the front cover and the rear cover while the outer surface of the front cover faces the outer surface of the rear cover;

wherein the front cover and rear cover form a cradle when the front cover is disposed at the fixed-angle with respect to the rear cover while facing an outer surface of the rear cover to support placement of the front cover and the rear cover in the fixed-angle configuration on the planar surface, said fixed angle thereby opening access to the portable terminal and cradling the portable terminal inclinedly with respect to the planar surface.

2. The protection cover of claim 1, further comprising one or more retainers provided on the inner surface of the rear cover to bind the portable terminal to the rear cover.

3. The protection cover of claim 2, wherein the one or more retainers comprise one or more hooks.

4. The protection cover of claim 1, further comprising a connection member for pivotally coupling the front cover to the rear cover.

5. The protection cover of claim 4, wherein the connection member is comprised of a flexible material, a first side end portion being connected to a side edge of the rear cover and a second side end portion being connected to a side edge of the front cover, wherein the front cover is coupled to the rear cover to pivot via the connection member.

6. The protection cover of claim 1, wherein the friction members are provided on lower edges of the rear cover and the front cover, respectively, when the front cover and the rear cover form a cradle.

7. The protection cover of claim 1, further comprising a connection member made of a flexible material, a first side end portion of the connection member being connected to an edge of the rear cover and a second side end portion of the connection member being connected to an edge of the front cover, wherein the front cover is coupled to the rear cover to pivot through the connection member, and the friction members are provided on lower portions of the rear cover and the front cover, respectively, when the front cover and the rear cover form a cradle.

8. The protection cover of claim 1, further comprising:

one or more retainers provided on the inner surface of the rear cover to bind the portable terminal to the rear cover; and wherein the friction members are provided on outer surfaces of the retainers and the binding member.

9. The protection cover of claim 4, further comprising an inner skin portion and an outer skin portion, wherein the inner skin portion and the outer skin portion are comprised of first portions for forming the rear cover, second portions for forming the front cover, and a third portion for forming the connection member, and the inner skin portion and the outer skin portion are coupled to each other while facing each other.

10. The protection cover of claim 9, wherein the inner skin portion and the outer skin portion are coupled to each other by being adhered or sewn to each other while facing each other.

11. The protection cover of claim 9, further comprising frames or boards interposed between the inner skin portion and the outer skin portion in the respective first and second portions for forming the rear cover and the front cover.

12. The protection cover of claim 11, further comprising one or more hooks provided on the inner surface of the rear cover to bind the portable terminal to the rear cover, wherein the hooks are formed integrally with the frames or boards.

13. The protection cover of claim 4, wherein the rear cover and the front cover further comprise frames or boards interposed therebetween, and wherein the connection member is a silicon member connecting the frames or boards to each other.

14. The protection cover of claim 13, further comprising an inner skin portion and an outer skin portion that covers the frames or boards.

15. The protection cover of claim 14, wherein at least one of the inner skin portion and outer skin portion is made of leather or a simulated leather.

16. The protection cover of claim 13, wherein the silicon member has two ends that partially cover both surfaces of the frames or boards.

17. The protection cover of claim 15, wherein the silicon member is fixed to the frames or boards by double injection or adhesion processing.

18. The protection cover of claim 1, wherein the portion of the front cover is a center portion and the second friction member is provided on the center portion of the front cover.

* * * * *